United States Patent [19]

Paasch

[11] 4,046,482

[45] Sept. 6, 1977

[54] PROTECTIVE COVER FOR SEWER GRATES

[76] Inventor: Harold R. Paasch, 405 Sharon Drive, Ankeny, Iowa 50021

[21] Appl. No.: 604,304

[22] Filed: Aug. 13, 1975

Related U.S. Application Data

[63] Continuation-in-part of Ser. No. 552,258, Feb. 24, 1975, and Ser. No. 408,161, Oct. 19, 1973, Pat. No. 3,914,911.

[51] Int. Cl.[2] ..... E01C 11/22

[52] U.S. Cl. ..... 404/4; 49/57

[58] Field of Search ..... 404/25, 26, 2, 4, 5; 49/33, 50, 55, 57; 210/164

[56] References Cited

U.S. PATENT DOCUMENTS

| | | | |
|---|---|---|---|
| 1,001,041 | 8/1911 | Jones | 49/33 |
| 2,563,617 | 8/1951 | Reilly et al. | 49/55 |
| 3,426,659 | 2/1969 | Clarke et al. | 404/25 |
| 3,881,832 | 5/1975 | Maguire | 404/4 |
| 3,914,911 | 10/1975 | Paasch | 404/4 |

FOREIGN PATENT DOCUMENTS

| | | | |
|---|---|---|---|
| 216,429 | 7/1961 | Australia | 404/4 |

*Primary Examiner*—Mervin Stein

*Attorney, Agent, or Firm*—Zarley, McKee, Thomte & Voorhees

[57] ABSTRACT

A protective cover for sewer grates comprising a pair of spaced apart longitudinally extending bars having a plurality of transversely extending bars adjustably secured thereto and extending therebetween. The longitudinally extending bars are at least partially received in openings formed in the sewer grate and have their upper opposite ends inclined inwardly and downwardly to prevent snow removal equipment from catching thereon. The transversely extending bars preferably have a convex upper surface and are selectively adjustably slidably received by the longitudinally extending bars so that the cover can be used on sewer grates having various dimensions. Fastening hook members hook the longitudinal extending bars and fastening brace members which engage the sewer grate bars to maintain the protective cover in position. Nuts are threadably mounted on the lower ends of the fastening hooks.

6 Claims, 6 Drawing Figures

PROTECTIVE COVER FOR SEWER GRATES

CROSS REFERENCE

This application is a continuation-in-part of application Ser. No. 552,258, filed Feb. 24, 1975 and application Ser. No. 408,161 filed Oct. 19, 1973, now U.S. Pat. No. 3,914,911 issued Oct. 28, 1975.

BACKGROUND OF THE INVENTION

This invention pertains to a protective cover and more particularly to a protective cover for a sewer grate. The narrow wheels of modern bicycles often fall through the slots in conventional sewer grates thereby creating a serious safety hazard.

Therefore, it is a principal object of the invention to provide a protective cover for sewer grates which prevents the wheels of bicycles from faling therethrough.

A further object of the invention is to provide a protective cover for sewer grates which can be used on sewer grates having various dimensions.

A further object of the invention is to provide a protective cover for sewer grates having means thereon to prevent snow removal equipment from catching thereon.

A further object of the invention is to provide a protective cover for sewer grates including means for rigidly mounting the same thereon.

A further object of the invention is to provide a protective cover for sewer grates which does not interfere with the flow of water therethrough.

A further object of the invention is to provide a protective cover for sewer grates which is economical of manufacture, durable in use and refined in appearance.

Still another object of this invention is to provide a protective cover for sewer grates which provide no abrupt surfaces and thereby eliminate the possibility of sudden jars or even upsets in the case of bicycles, to vehicles passing over said cover.

Yet another object is to provide a sewer cover which employs transversely ending bars which will not bend easily upon transfer of shock thereto from moving vehicles.

These and other objects, and the manner of accomplishing them will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 1:
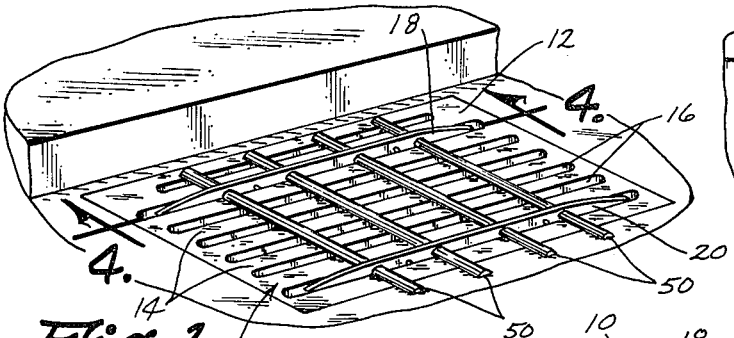
FIG. 1 is a perspective view illustrating the protective cover mounted on a conventional sewer grate.
Figure 2:
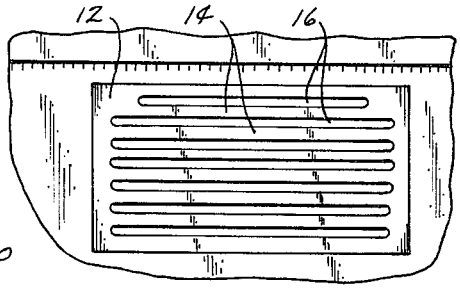
FIG. 2 is a plan view of a conventional sewer grate.

The numeral 10 refers generally to the protective cover of this invention while the numeral 12 refers to a conventional sewer grate. Sewer grate 12 is provided with a plurality of longitudinally extending bars 14 defining longitudinally extending openings 16 therebetween.

Figure 3:
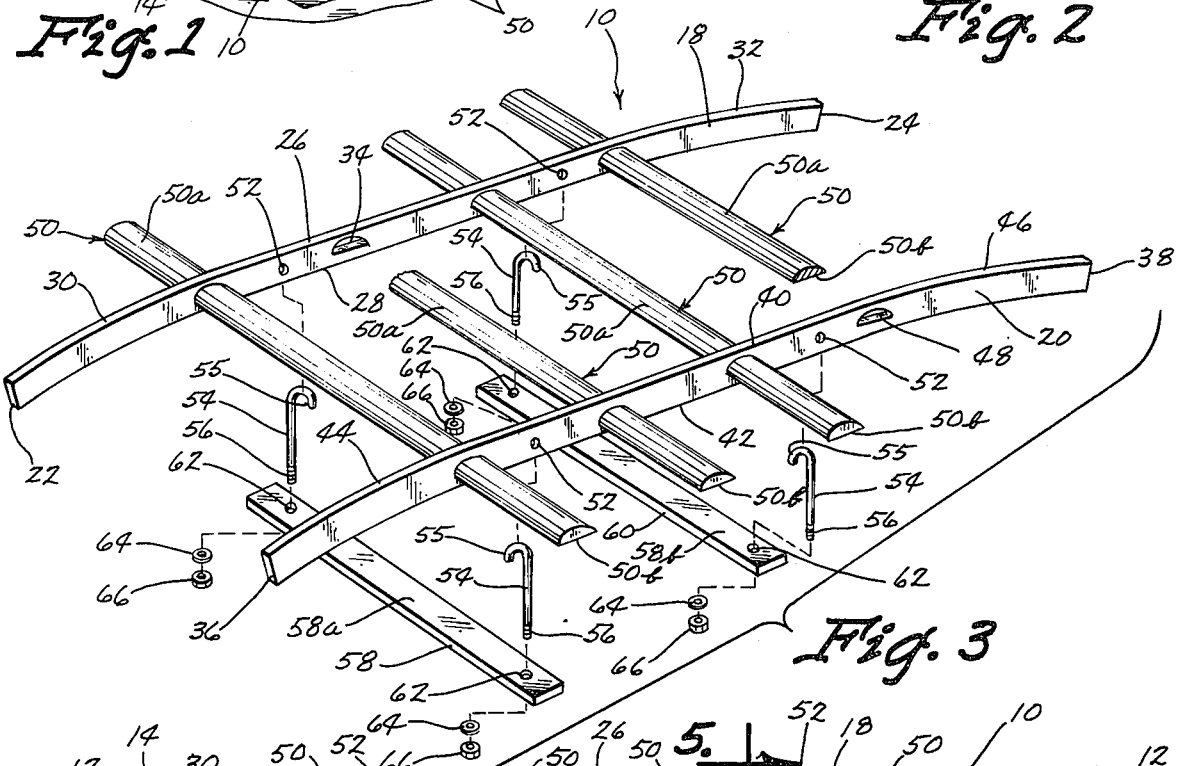
FIG. 3 is an exploded perspective view of the protective cover of this invention.
Figure 4:
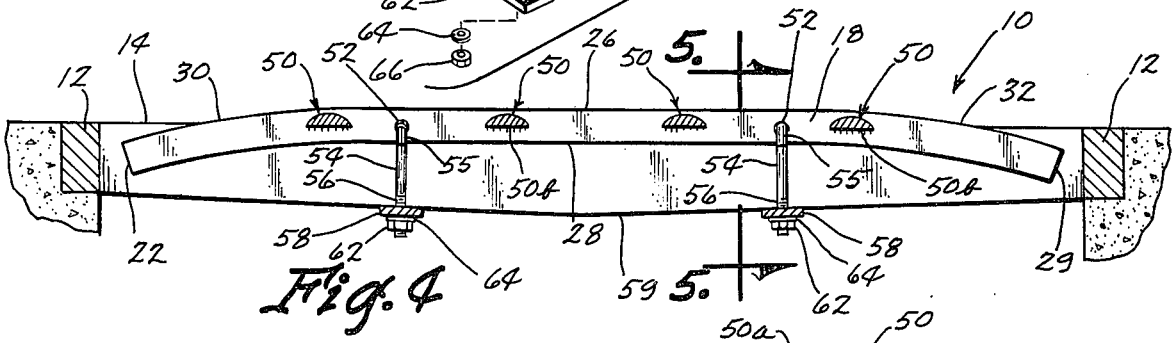
FIG. 4 is a longitudinal sectional view illustrating the protective cover mounted on a sewer grate.

Cover 10 comprises a pair of spaced apart longitudinally extending bars 18 and 20. For purposes of description, bar 18 will be described as having opposite ends 22 and 24, upper end 26, and lower end 28. As seen in FIG. 3, bar 18 is provided with inwardly and downwardly inclined portions 30 and 32 at its upper opposite ends for a purpose to be described in more detail hereinafter. Bar 18 is provided with a plurality of openings 34 formed therein adjacent the upper end thereof. Openings 34 conform to the cross sectional shape of the transversely extending bars to be hereinafter described.

For purposes of description, bar 20 will be described as comprising opposite ends 36 and 38, upper end 40 and lower end 42. Bar 20 is provided with inwardly and downwardly inclined portions 44 and 46 at its upper opposite ends as seen in FIG. 3. Bar 20 is also provided with a plurality of spaced apart openings 48 formed therein adjacent the upper end thereof.

Figure 6:
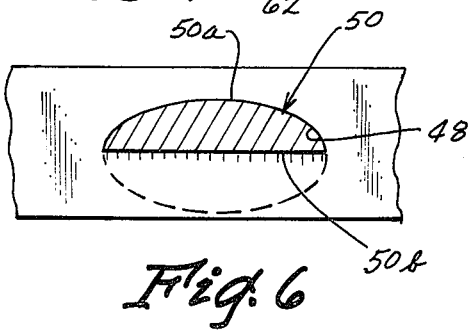
FIG. 6 is an enlarged end view showing a cross section of one of the transversely extending bars as it extends through one of the longitudinally extending bars.

The numeral 50 refers to transversely extending bars which are selectively slidably received in one of the openings 34 in bar 18 and one of the openings 48 in bar 20 as seen in FIG. 3. Each of bars 50 is provided with an upper convex surface **50*a* and a lower flat surface 50*b*. This provides for increased strength of bars 50 when compared with like bars having flat upper surfaces, provides for prevention of abrupt jarring shock when a vehicle contacts bars 50 and inhibits bending of bars 50 when they receive abrupt shocks transferred from rapidly moving vehicles. Bars 50, as shown in FIG. 6 can conveniently be made by cutting bars of oval cross section along their major diameter axis. Thus one oval cross section will provide two bars 50.**

Each of bars 18 and 20 is provided with a pair of hook fastener openings 52. Fastening hook 54 has a hook end 55 and a threaded opposite end 56. Fastening brace members 58 and 60 are provided and extend transverse to longitudinal extending bars 18 and 20 and each have flat upper surfaces **58*a* and 58*b* which may engage lower edge 59 of sewer grate 12. Braces 58 and 60 are each provided with hook receiving openings 62. Hook end 55 is hooked in opening 52 and threaded end 56 receives brace member 58 through opening 62 and washer 64 and bolt 66 are secured to threaded end 56** to rigidly secure the protective cover of the invention to the sewer grate.

Figure 5:
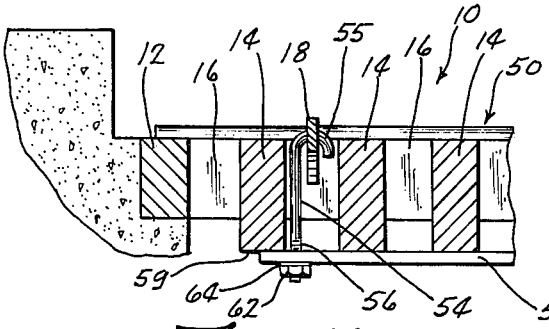
FIG. 5 is an enlarged sectional view seen on lines 5—5 of FIG. 4.

The sewer grate 12 would ordinarily be removed from the opening in the street to facilitate the installation of the cover 10 thereon. The bars 18 and 20 are positioned in a pair of the openings 16 as seen in FIG. 1 with the bars 50 extending across the upper surface of the bars 14 as also seen in FIG. 1. The fact that the bars 50 are slidably received by the bars 18 and 20 permits the bars 18 and 20 to be moved towards or away from each other so that the device can accommodate sewer grates having various dimensions. The fastening hooks 54 are then hooked through the openings 52 and extended downwardly through openings 62 in brace members 58 and 60 with washers 64 and bolts 66 engaged on the threaded end 56. Braces 58 and 60 engage the lower ends 59 of the sewer grate as seen in FIG. 5 to positively maintain the protective cover in the proper position. The sewer grate may then be re-installed in the opening in the street.

It can be seen that the bars 50 prevent a bicycle wheel from passing downwardly through the openings 16 due to the relatively close spacing thereof. The inwardly and downwardly inclined end portions on the bars 18 and 20 prevents snow removal equipment from catching on the same which could provide a serious maintenance hazard, and further prevent an abrupt surface for which might upset moving vehicles or their riders in the case of transfer of abrupt shock thereto. Thus it can be seen that a protective cover has been disclosed for a sewer grate which prevents the narrow wheels of modern bicycles from falling through the slots or openings in the sewer grate and yet which provides a minimum of interference to traffic over the cover. It can be seen that the protective cover of this invention accomplishes at least all of its stated objectives.

What is claimed is:

1. In combination with a horizontally disposed sewer grate having a plurality of longitudinally extending spaced apart bars defining elongated openings therebetween, the invention comprising, a bicycle wheel protective cover secured to said sewer grate, said protective cover having at least first and second elongated bar members, said bar members having a length substantially the same as the elongated openings in said sewer grate and being at least partially positioned within two of such openings, a plurality of spaced apart support bars secured to said bar members and extending in a lateral direction with respect thereto over the longitudinally extending bars on said sewer grate and over the elongated openings in said grate to prevent a bicycle wheel from moving downwardly through the elongated openings in said grate, said support bars being selectively adjustably secured to said first and second bar members to permit the cover to be secured to sewer grates having various grate dimensions, and securing means rigidly securing said protective cover to said sewer grate to prevent relative movement therebetween.

2. The protective cover of claim 1 wherein the upper opposite ends of said first and second elongated bar members are inwardly and downwardly inclined.

3. The protective cover of claim 2 wherein said support bars have an upper convex surface.

4. The protective cover of claim 3 wherein said support bars have a lower flat surface.

5. The protective cover of claim 1 wherein said cover includes securing means to engage the under surface of said sewer grate and securely hold said protective cover to said sewer grate.

6. The protective cover of claim 8 wherein said cover includes securing means to engage the under surface of said sewer grate and securely hold said protective cover to said sewer grate, said securing means including a pair of brace members to engage the bottom surface of said sewer grate and a bolt means extending through said brace members and secured to said brace members and also secured to one of said elongated members.

* * * * *